US010718177B2

(12) United States Patent
Cook

(10) Patent No.: US 10,718,177 B2
(45) Date of Patent: Jul. 21, 2020

(54) COMPOSITE BLOCK FRAC TREE

(71) Applicant: FMC Technologies, Inc., Houston, TX (US)

(72) Inventor: James Cook, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 16/192,570

(22) Filed: Nov. 15, 2018

(65) Prior Publication Data

US 2019/0153803 A1 May 23, 2019

Related U.S. Application Data

(60) Provisional application No. 62/587,765, filed on Nov. 17, 2017.

(51) Int. Cl.

| | |
|---|---|
| ***E21B 33/068*** | (2006.01) |
| ***E21B 34/02*** | (2006.01) |
| ***E21B 43/26*** | (2006.01) |
| ***E21B 33/03*** | (2006.01) |

(52) U.S. Cl.

CPC ..... *E21B 33/068* (2013.01); *E21B 33/03* (2013.01); *E21B 34/02* (2013.01); *E21B 43/26* (2013.01)

(58) Field of Classification Search

None

See application file for complete search history.

(56) References Cited

U.S. PATENT DOCUMENTS

| | | | | |
|---|---|---|---|---|
| 8,544,535 | B2 * | 10/2013 | Cote | E21B 33/03 166/75.13 |
| 8,944,159 | B2 * | 2/2015 | Guidry | E21B 34/02 166/90.1 |
| 9,127,545 | B2 * | 9/2015 | Kajaria | E21B 43/26 |
| 10,294,766 | B2 * | 5/2019 | Saleh | E21B 33/038 |
| 2019/0010781 | A1 * | 1/2019 | Tran | E21B 43/26 |

OTHER PUBLICATIONS

"Composite Frac Tree System: Lower tree profile enhances safety and reliability". Cameron: A Schlumberger Company. product profile page; URL: slb.com/compositefractree (1 page).

* cited by examiner

*Primary Examiner* — Matthew R Buck
*Assistant Examiner* — Douglas S Wood
(74) *Attorney, Agent, or Firm* — Osha Liang LLP

(57) ABSTRACT

A connector block having a single piece body may be configured for use in a Christmas tree. The connector block may include an axial bore formed therethrough, one or more valve chambers, passing fully through the connector block and intersecting the axial bore, one or more frac bores, extending from an outer surface of the connector block to the axial bore; and, one or more wing bores, extending from the outer surface of the connector block to the axial bore.

18 Claims, 10 Drawing Sheets

COMPOSITE BLOCK FRAC TREE

BACKGROUND

Christmas trees are assemblies of valves and other components used at well sites to control the flow of oil or gas out of the well and the flow of other fluids, such as frac fluid into the well. A traditional Christmas tree is shown in FIG. 1. The Christmas tree 10 may include two gate valves 12, 14, a central connector 16, and a swab valve 18 having a common axial bore (not shown). An upper end of the swab valve 18 may terminate at a cap 20. A lower end of the lower gate valve 12 may terminate at a wellhead connector 22. Four wing valves 24*a*-24*d* may be connected to the central connector in a transverse direction. A frac inlet (26 in FIG. 2) may also be connected to the central connector 16.

The Christmas tree 10 may have, for example, a height of approximately fourteen to fifteen feet, a width of approximately twelve to thirteen feet and a weight of approximately twenty-eight thousand pounds. An operator may have to use a lift or a platform to operate the wing valves 24*a*-24*d* and/or the swab valve 18. This may make assembly and use of the Christmas tree 10 more consuming of time, personnel, and/or equipment, and may add more safety concerns to the assembly and operation. The Christmas tree 10 may be too large to transport fully assembled, so the Christmas tree 10 may have to be assembled at a well site. The wing valves 24*a*-24*d*, the swab valve 18, and the gate valves 12, 14 may be capped at a single end, which may make the Christmas tree 10 difficult to clean because the opposite end of the valves may not be opened, thereby providing a "trap" for debris in the valve.

FIG. 2 illustrates a traditional well site including a Christmas tree 10. A frac inlet 26 is connected the central connector 16 of the Christmas tree 10. A frac line 28 is connected to the frac inlet 28. A flow line 30 and a pump line 32 are connected to the wing valves 24*a*, 24*d*. The frac line 28, the flow line 30, and the pump line 32 may have to be lifted a significant height off of the ground to be connected to the Christmas tree 10. This may make assembly of the system more difficult and failure of the Christmas tree 10 and/or the frac line 28, the flow line 30, and the pump line 32 more likely.

SUMMARY OF THE DISCLOSURE

Embodiments disclosed herein provide a connector block configured for use in a Christmas tree, a Christmas tree including the connector block, and a method of manufacturing the Christmas tree.

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the present disclosure relates to a connector block having a single piece body which may be configured for use in a Christmas tree. The connector block may include an axial bore formed therethrough, one or more valve chambers, passing fully through the connector block and intersecting the axial bore, one or more frac bores, extending from an outer surface of the connector block to the axial bore; and, one or more wing bores, extending from the outer surface of the connector block to the axial bore.

In another aspect, the present disclosure relates to a connector block having a single piece body which may be configured for use in a Christmas tree. The connector block may include an axial bore formed therethrough, the axial bore having an axis, two valve chambers, passing fully through the connector block and intersecting the axial bore, each of the two valve chambers having an axis, a frac bore, extending from an outer surface of the connector block to the axial bore, the frac bore having an axis, and two wing bores, extending from the outer surface of the connector block to the axial bore.

In another aspect, the present disclosure relates to a Christmas tree including a connector block, one or more valve assemblies, one or more wing valve assemblies, a frac connector, a lower component, and an upper component. The connector block may include an axial bore formed therethrough, one or more valve chambers, passing fully through the connector block and intersecting the axial bore, a frac bore, extending from an outer surface of the connector block to the axial bore, and one or more wing bores, extending from the outer surface of the connector block to the axial bore. Each of the one or more valve assemblies may be disposed within a wing bore, and each of the one or more valve assemblies may include a flow control element disposed within the axial bore and a means of actuating the flow control element. The one or more wing valve assemblies may be connected to the connector block, such that a longitudinal bore of each of the one or more wing valve assemblies is fluidly connected to one of the one or more wing bores. The frac connector may be connected to the connector block, such that a bore of the frac connector is fluidly connected to the frac bore. The lower component may be connected to a lower end of the connector block, such that a bore of the lower component is fluidly connected to the axial bore. An upper component may be connected to an upper end of the connector block.

In another aspect, the present disclosure relates to a method of assembling a Christmas tree including the following steps: forming a connector block, attaching a frac connector to a connector block, such that a bore of the frac connector is fluidly connected to a frac bore of the connector block, attaching one or more wing valve assemblies to a connector block, such that a longitudinal bore of each wing valve assembly is fluidly connected to a wing bore of the connector block attaching a lower component to a lower end of the connector block, such that an axial bore of the lower component is fluidly connected to the axial bore, and attaching an upper component to a upper end of the connector block, such that an axial bore of the lower component is fluidly connected to the axial bore.

Other aspects and advantages will be apparent from the following description and the appended claims.

DETAILED DESCRIPTION

Figure 1:
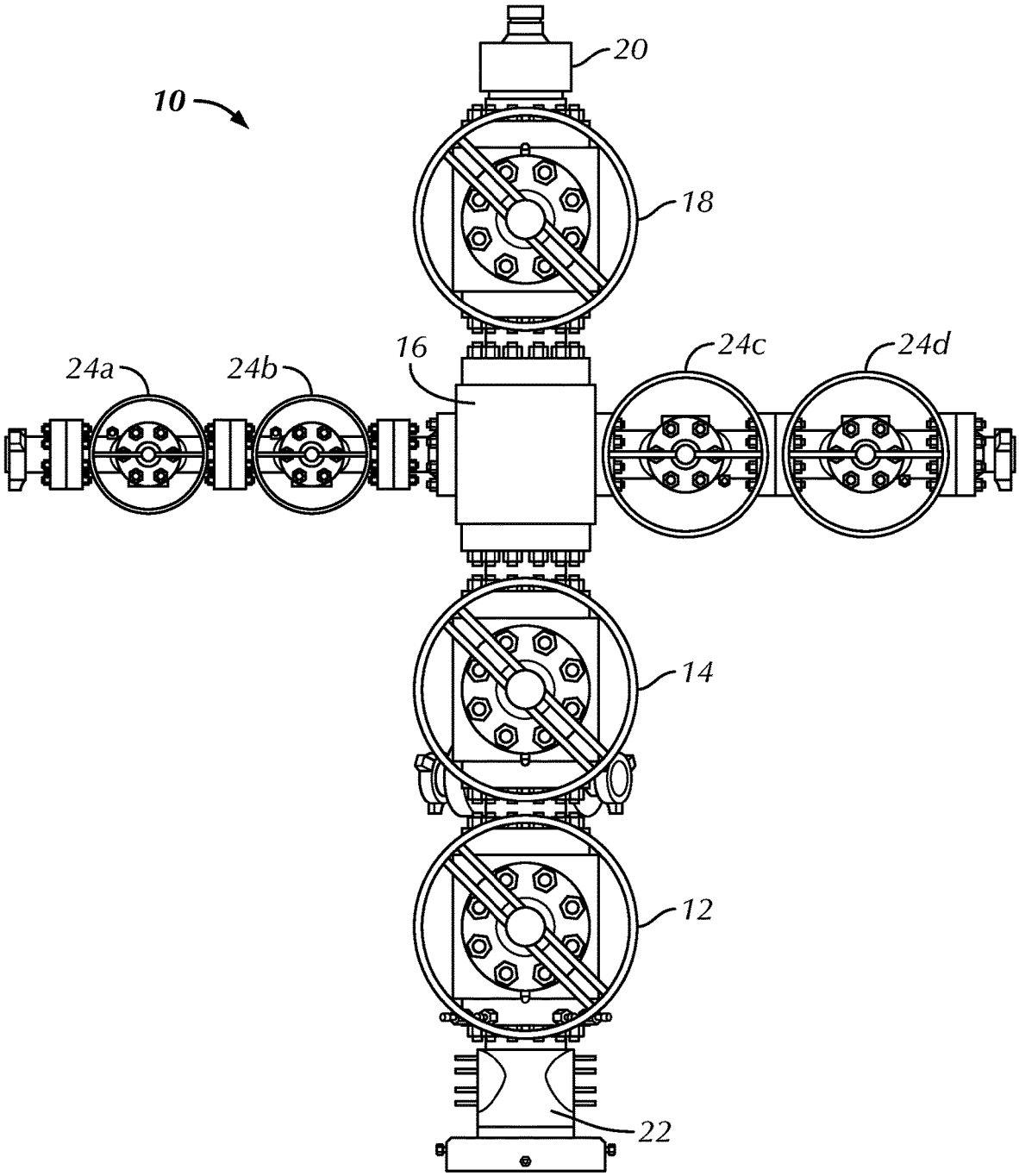
FIG. 1 (Prior Art)
FIG. 1 is a perspective view of a Christmas tree in accordance with the prior art.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

As used herein, the term "coupled" or "coupled to" or "connected" or "connected to" may indicate establishing either a direct or indirect connection, and is not limited to either unless expressly referenced as such.

Embodiments of the present disclosure relate to a connector block for use in a Christmas tree, and a Christmas tree including the connector block. Embodiments of the present disclosure also relate to a method of manufacturing and using a Christmas tree including the connector block. The connector block may include connections for one or more wing valves, a frac inlet, a gate valve, and/or other components of the Christmas tree, such as that illustrated in FIGS. 1 and 2, and may include an upper master valve and a swab valve. A Christmas tree including the connector block may have a reduced profile compared to a standard Christmas tree and may be easier to clean and operate. The connector block may also be relatively simple and inexpensive to manufacture.

Figure 3A:
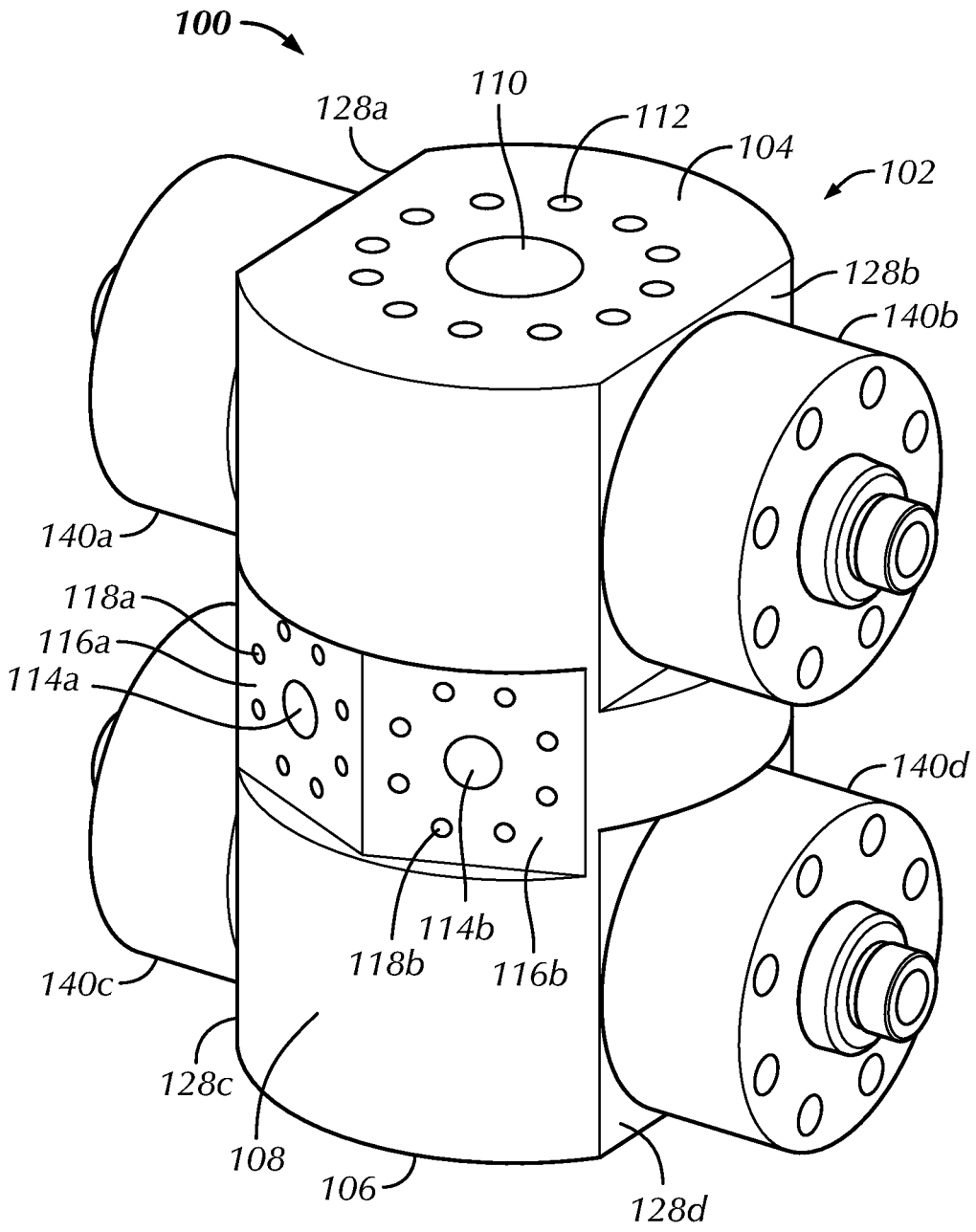
FIG. 3*a* is a front perspective view of a connector block in accordance with the present disclosure.
Figure 3B:
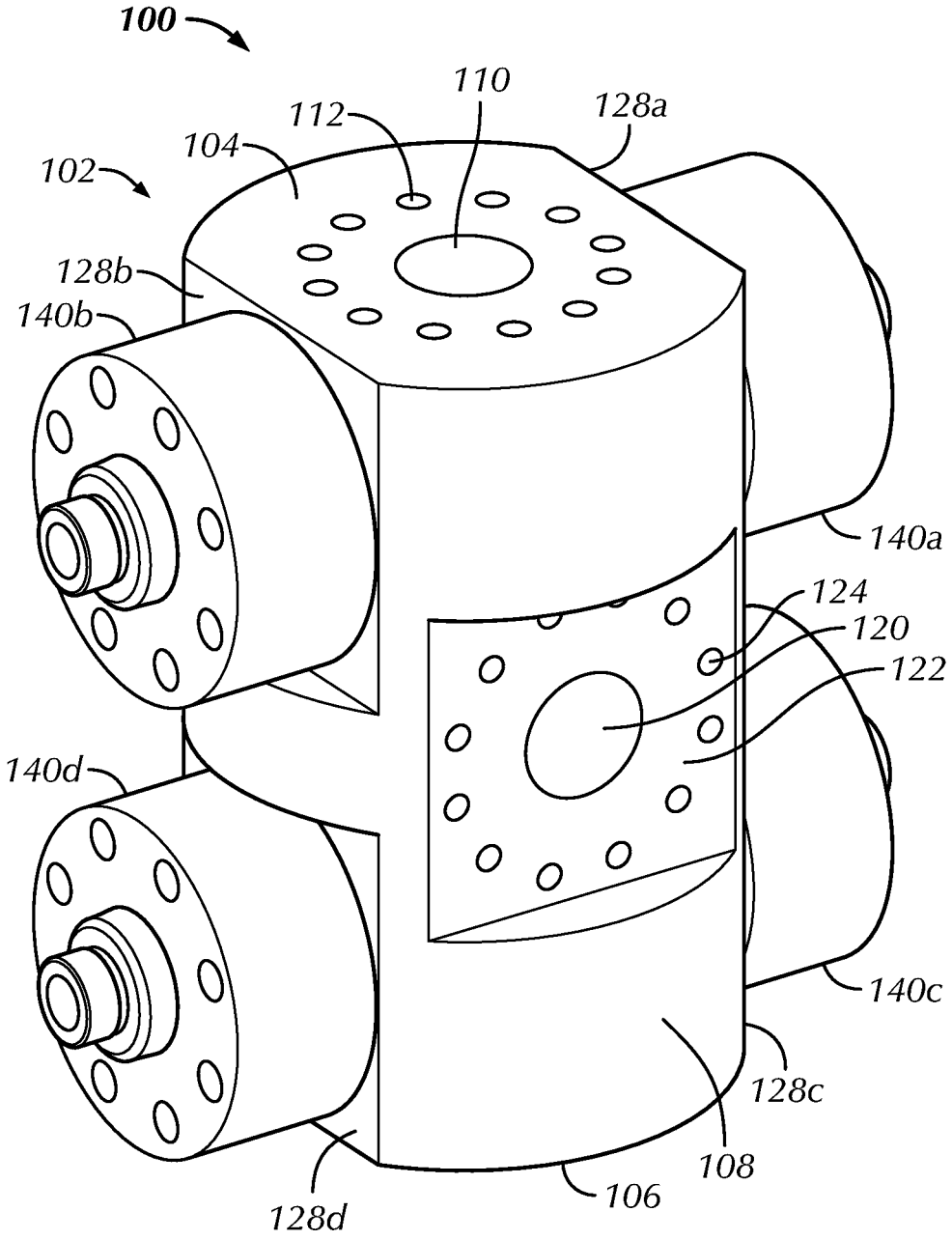
FIG. 3*b* is a back perspective view of a connector block in accordance with the present disclosure.
Figure 3C:
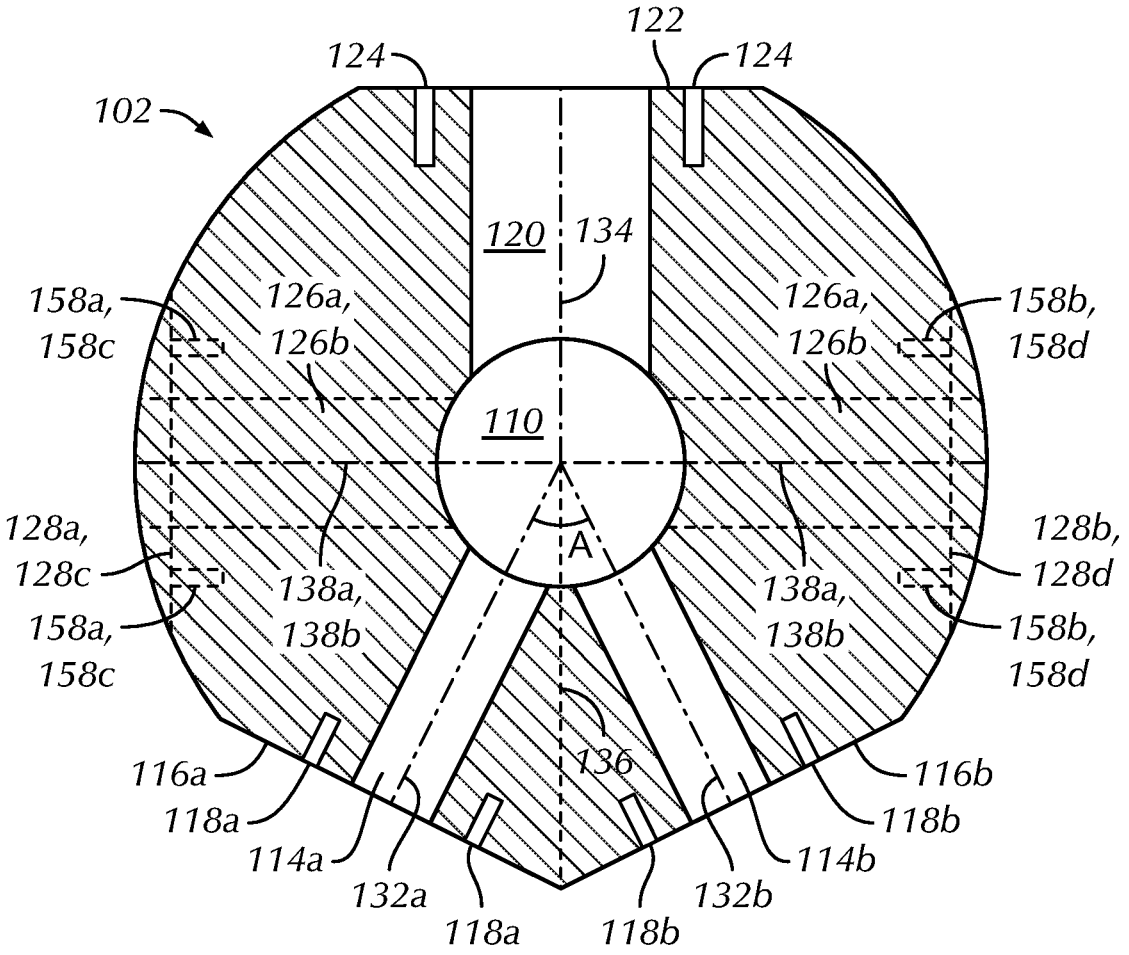
FIG. 3*c* is a cross-section view of a connector block in accordance with the present disclosure.

In one aspect, the present disclosure relates to a connector block configured for use in a Christmas tree. FIGS. 3*a*-3*c* illustrate an embodiment of the connector block 100, showing a front view, a back view, and a cross-section view, respectively. The connector block 100 may have a single piece construction. In some embodiments, the connector block 100 may have any type of construction known in the art.

The connector block 100 may include a body 102. The body 102 may have an upper face 104, a lower face 106, and an outer surface 108. The upper face 104 and the lower face 106 may be flat surfaces. In some embodiments, as illustrated in FIGS. 3*a*-3*b*, the body 102 may have a generally cylindrical shape. The outer surface 108 may be an approximately round surface. In some embodiments, the body 102 may have any shape known in the art, for example, a cubic, rectangular prismatic, elliptical cylinder, or irregular shape. The outer surface 108 may include one or more surfaces, which may be flat or curved. In some embodiments, the body 102 may have a diameter of between ten and fifty inches, between twenty and forty inches, or about twenty-nine inches.

The connector block 100 may include an axial bore 110 formed through the body 102. The axial bore 110 may extend from the upper face 104 to the lower face 106. The axial bore 110 may be normal to the upper face 104 and the lower face 106 and may extend through the center of the body 102. The connector block 100 may include an upper connector 112 and a lower connector (130 in FIGS. 5*a*-5*b*) formed on the upper face 104 and the lower face 106 respectively configured to connect components (not shown) having bores formed therethrough to the connector block 100, such the bores of the components are in fluid communication with the axial bore 110. In some embodiments, as shown in FIGS. 3*a*-3*b*, the upper connector 112 and lower connector (not shown) may be a set of bolt holes formed around the ends of the axial bore 110 which intersect the upper surface 104 and the lower surface 106. In some embodiments, the upper connector 112 and lower connector (not shown) may be any form of connector known in the art, which are configured to withstand operating conditions experienced by the Christmas tree.

The connector block 100 may include one or more wing bores 114*a*, 114*b* formed through the body 102. The wing bore 114*a*, 114*b* may comprise circular openings that have the same diameter, for example, about four inches, which may be smaller than the diameter of the axial bore 110, which may be, for instance, seven inches. The wing bores 114*a*, 114*b* may be configured for connection to wing valve assemblies (e.g., 208 in FIGS. 5*a*-5*b*). In some embodiments, as shown in FIG. 3*a*, the connector block 100 may have two wing bores 114*a*, 114*b* formed therethrough. Each wing bore 114*a*, 114*b* may extend from the outer surface 108 of the body 102 to the axial bore 110, such that the wing bores 114*a*, 114*b* intersect and are in fluid communication with the axial bore 110.

In some embodiments, as shown in FIG. 3*c*, the central axes 132*a*, 132*b* of the wing bores 114*a*, 114*b* may be normal to the axial bore 110 and may be in the same plane as each other. The plane may be normal to the axial bore 110. The central axes 132*a*, 132*b* may intersect at a point within the axial bore 110, which may be the midpoint of the axial bore 110. An angle A may be formed between the central axes 132*a*, 132*b* of the wing bores. In some embodiments in which the connector block 100 includes two wing bores 114*a*, 114*b*, the angle A may be between five and one hundred twenty degrees, between fifteen and sixty degrees, between twenty and forty degrees, or approximately twenty-seven degrees. In some embodiments, the connector block 100 includes more than two wing bores 114*a*, 114*b*. An angle A may be formed between each consecutive pair of wing bores. The angles A may be the same as each other or different from each other. The angle(s) A may be chosen to allow installation and use of equipment (not shown) attached to the connector block 100 via wing connectors 118*a*, 118*b*, such that the equipment does not interfere with valves (152, 154 in FIGS. 5*a*, 5*b*) disposed within the valve chambers 126*a*, 126*b*. In some embodiments, the angle(s) A may be chosen such that an angle between the central axes 132*a*, 132*b* of the outermost wing bores 126*a*, 126*b* is less than one-hundred eighty degrees.

The outer surface 108 of the body 102 may include wing connection faces 116*a*, 116*b* formed around the points at which the wing bores 114*a*, 114*b* intersect the outer surface 108. The wing connection faces 116*a*, 116*b* may be flat surfaces and may be normal to the wing bores 114*a*, 114*b*. Wing connectors 118*a*, 118*b* may be formed to connect components (not shown) having bores formed therethrough to the connector block 100, such that a bore of each component is in fluid communication with a wing bore 114*a*, 114*b*. In some embodiments, the components may be frac inlet (e.g., 210 in FIGS. 5*a*-5*b*). In some embodiments, as shown in FIG. 3*a*, wing connectors 118*a*, 118*b* may be a set of bolt holes formed around the ends of each wing bore 114*a*, 114*b* which intersects wing connection faces 116*a*, 116*b*. In some embodiments, wing connectors 118*a*, 118*b* may be any form of connector known in the art.

The connector block 100 may include one or more frac bores 120 formed through the body 102. In certain embodiments, the frac bores 120 may have a diameter that is larger than the circumference of the wing bores 114*a*, 114*b* and substantially the same as the diameter of the axial bore 110. For instance, both the frac bores 120 and the axial bore 110 may have seven inch diameters. The frac bores 120 may be configured for connection to frac inlets (e.g., 210 in FIGS. 5*a*-5*b*). In some embodiments, as shown in FIG. 3*b*, the connector block 100 may include one frac bore 120. The frac bore 120 may extend from the outer surface 108 of the body 102 to the axial bore 110, such that the frac bore 120 intersects and is in fluid communication with the axial bore 110. In some embodiments, the frac bore 120 may be normal to the axial bore 110. In some embodiments, a diameter of the frac bore 120 may be between two and fifteen inches, between four and ten inches, or about ten inches.

In some embodiments, as shown in FIG. 3*c*, a central axis 134 of the frac bore 120 may be in the same plane as the central axes 132*a*, 132*b* of the wing bores 114*a*, 114*b*. In some embodiments, the central axis 134 may be in a different plane. The central axis 134 of the frac bore 120 may be substantially parallel and/or collinear with a line 136 which bisects the central axes 132*a*, 132*b* of the wing bores 114*a*, 114*b*.

The outer surface 108 of the body 102 may include a frac connection faces 122 formed around the point at which the frac bore 122 intersects the outer surface 108. The frac connection face 122 may be a flat surface and may be normal to the frac bore 120. A frac connector 124 may be formed to connect a component (not shown) having a bore formed therethrough to the connector block 100, such that a bore of the component is in fluid communication with frac bore 120. In some embodiments, the component may be a frac inlet (210 in FIG. 5*b*). In some embodiments, as shown in FIG. 3*b*, frac connector 124 may be a set of bolt holes formed around the end of the frac bore 120 which intersects frac connection face 122. In some embodiments, the frac connector 124 may be any form of connector known in the art, which are configured to withstand operating conditions experienced by the Christmas tree. In embodiments of the body 102 including more than one frac bore 122, the outer surface 108 may include more than one frac connection face 122, and each frac connection faction 122 may have a frac connector 124 formed thereon, such that a component may be connected to each frac bore 120.

The connector block 100 may include one or more valve chambers 126*a*, 126*b* formed through the body 102. In some embodiments, as shown in FIGS. 3*a*-3*b*, the connector block 100 may include two valve chambers 126*a*, 126*b*. The valve chambers 126*a*, 126*b* may be configured to receive components of valves (152, 154 in FIGS. 5*a*-5*b*) assembled therein. Embodiments of the valve components will be discussed in more detail below. The valve chambers 126*a*, 126*b* may extend entirely through the body 102 and may intersect the axial bore 110. The valve chambers 126*a*, 126*b* may be normal to the axial bore 110.

In some embodiments, as shown in FIGS. 3*a*-3*b*, an axis of each of the valve chambers 126*a*, 126*b* and the axis of the axial bore 110 may be located in a single plane. The axes of each of the one or more valve chambers 126*a*, 126*b* may be substantially parallel to the axes of each of the other of the one or more valve chambers 126*a*, 126*b*, such that the axes are rotated about zero degrees from each other. The axes of the wing bores 114*a*, 114*b* and the axis of the frac bore 120 may be located in a single plane, as shown in FIG. 3*c*, which may be normal to the plane containing the axes of the valve chambers 126*a*, 126*b* and the axis of the axial bore 110. One valve chamber 126*a* may be disposed above the plane containing the axes 132*a*, 132*b*, 134 of the wing bores 114*a*, 114*b* and the frac bore 120 and one valve chamber 126*b* may be disposed below the plane. In some embodiments, both valve chambers 126*a*, 126*b* may be located on a single side of the plane. A projection of the central axes 138*a*, 138*b* of the valve chambers 126*a*, 126*b* onto the plane containing the plane containing the axes 132*a*, 132*b*, 134 of the wing bores 114*a*, 114*b* and the frac bore 120 may be normal to the central axis 134 of the frac bore 120.

The outer surface 108 of the body 102 may include bonnet connection faces 128*a*-128*d* formed around the points at which the valve chambers 126*a*, 126*b* intersect the outer surface 108. The bonnet connection faces 128*a*-128*d* may be flat surfaces and may be normal to the valve chambers 126*a*, 126*b*. Bonnet connectors 158*a*-158*d* may be formed to connect bonnets 140*a*-140*d* to the connection block 100, such that each bonnet covers an end of a valve chamber 126*a*, 126*b*. In some embodiments the bonnet connectors 158*a*-158*d* may be a set of bolt holes formed around the ends of each valve chamber 126*a*, 126*b* which intersects the bonnet connection faces 128*a*-128*d*. In some embodiments, bonnet connectors 158*a*-158*d* may be any form of connector known in the art.

The bores 110, 114*a*, 114*b*, 120, and the chambers 126*a*, 126*b* may be disposed in the connector block 100 such that the total volume of the connector block 100 necessary to withstand the operating pressure within the bores and chambers is reduced or minimized. The connector block 100 may be composed of a material which is resistant to erosion and corrosion. In some embodiments, the bores 110, 114*a*, 114*b*, 120, and the chambers 126*a*, 126*b* may be lined with a material which is resistant to erosion and/or corrosion.

Figure 4:
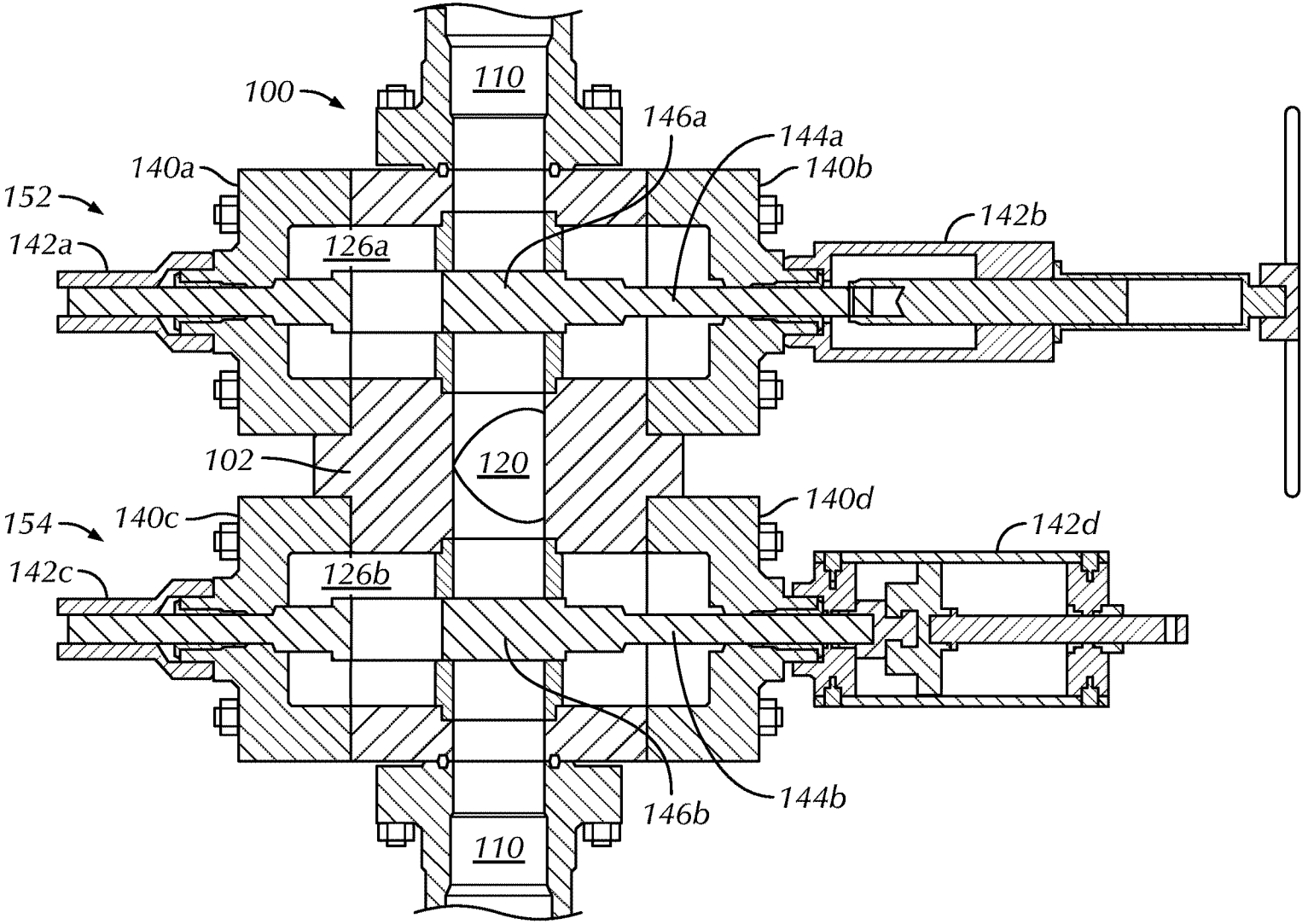
FIG. 4 is a cross-section view of a connector block in accordance with the present disclosure.

FIG. 4 illustrates a cross-section view of the connector block 100 showing the valve components within the valve chambers 126*a*, 126*b*. A valve may be disposed within each valve chamber 126*a*, 126*b*. The valves may, for example, be a swab valve 152 and an upper master valve 154.

Each valve chamber 126*a*, 126*b* may be capped by a bonnet 140*a*-140*d* on each end. Rod housings 142*a*-142*d* may extend from the bonnets 140*a*-140*d*. The rod housings 142*a*, 142*c* on a first side of the connector block 100 may be configured so that each is attached to a valve actuator (156 in FIGS. 5*a*-5*b*). A rod 144*a*, 144*b* may extend through each valve chamber 126*a*, 126*b*. The rods 144*a*, 144*b* may extend from a rod housing 140*a*, 140*c* on a first side of the body 102 to a rod housing 140*b*, 140*d* on a second side of the housing. In some embodiments, the rods 144*a*, 144*b* may be drive stems.

The dual bonnet configuration of the valves 152, 154 may make the valves easier to clean than conventional valves having single bonnet configurations. During cleaning, both bonnets 140*a*-140*d* covering a valve chamber 126*a*, 126*b* may be removed so that the chamber 126*a*, 126*b* may be cleaned without pushing debris to an end of the chamber 126*a*, 126*b* or having to scoop or suction debris out of the chamber 126*a*, 126*b*. Increasing the ease with which the valve chambers 126*a*, 126*b* may be cleaned may improve efficiency and reduce operating costs and downtime for Christmas trees including the connector block 100. In some embodiments, one or more of the valves 152, 154 may have a single bonnet configuration.

The valves 152, 154 may comprise a flow control element 146*a*, 146*b* disposed on the rods 144*a*, 144*b*. In some embodiments, as shown in FIG. 4, the valves 152, 154 may be gate valves and the flow control elements 146*a*, 146*b* may be gates. In some embodiments, the valves 152, 154 may be plug valves or any other type of valves known in the art. If a connector block 100 includes more than one valve, both valves may be of the same type or may be of different types. The flow control elements 146*a*, 146*b* may be manipulated via actuation of the rods 144*a*, 144*b*, such that the flow control elements 146*a*, 146*b* may be configured to block flow through the axial bore 110, fully allow flow through the axial bore 110, or restrict flow through the axial bore 110.

The bonnets 140*a*-140*d* may be configured to allow the flow control elements 146*a*, 146*b* to travel sufficient distance. The rod housings 140*a*, 140*b* may include locking mechanisms (not shown) allowing the rods 144*a*, 144*b* and the flow control elements 146*a*, 146*b* to be locked in a desired position.

FIG. 4 also illustrates a frac bore 120. In certain embodiments, the frac bore 120 may have a diameter that is larger than the circumference of the wing bores 114*a*, 114*b* and substantially the same as the diameter of the axial bore 110. For instance, both the frac bores 120 and the axial bore 110 may have seven inch diameters.

Figure 5A:
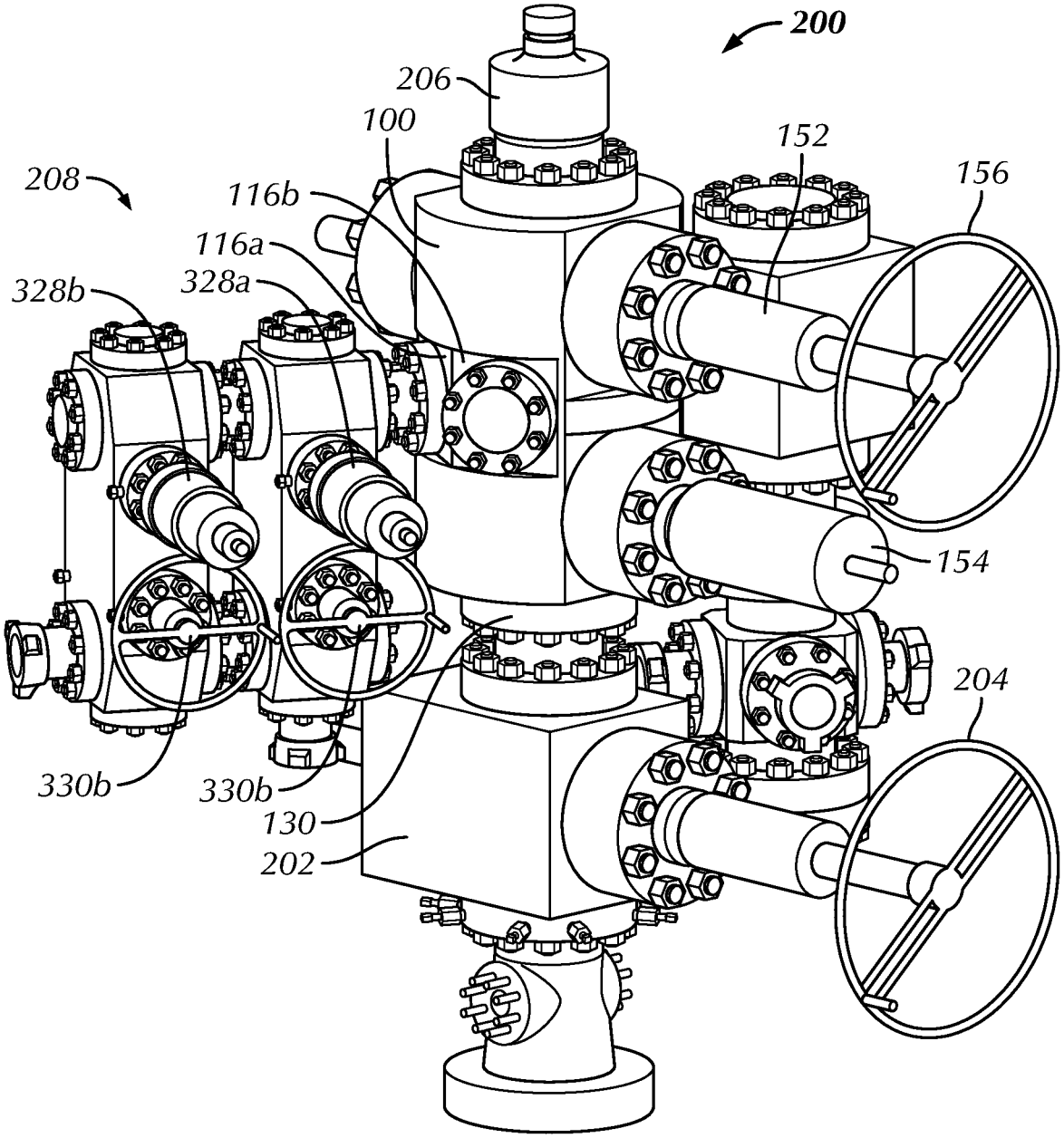
FIG. 5*a* is a front perspective view of a Christmas tree in accordance with the present disclosure.
Figure 5B:
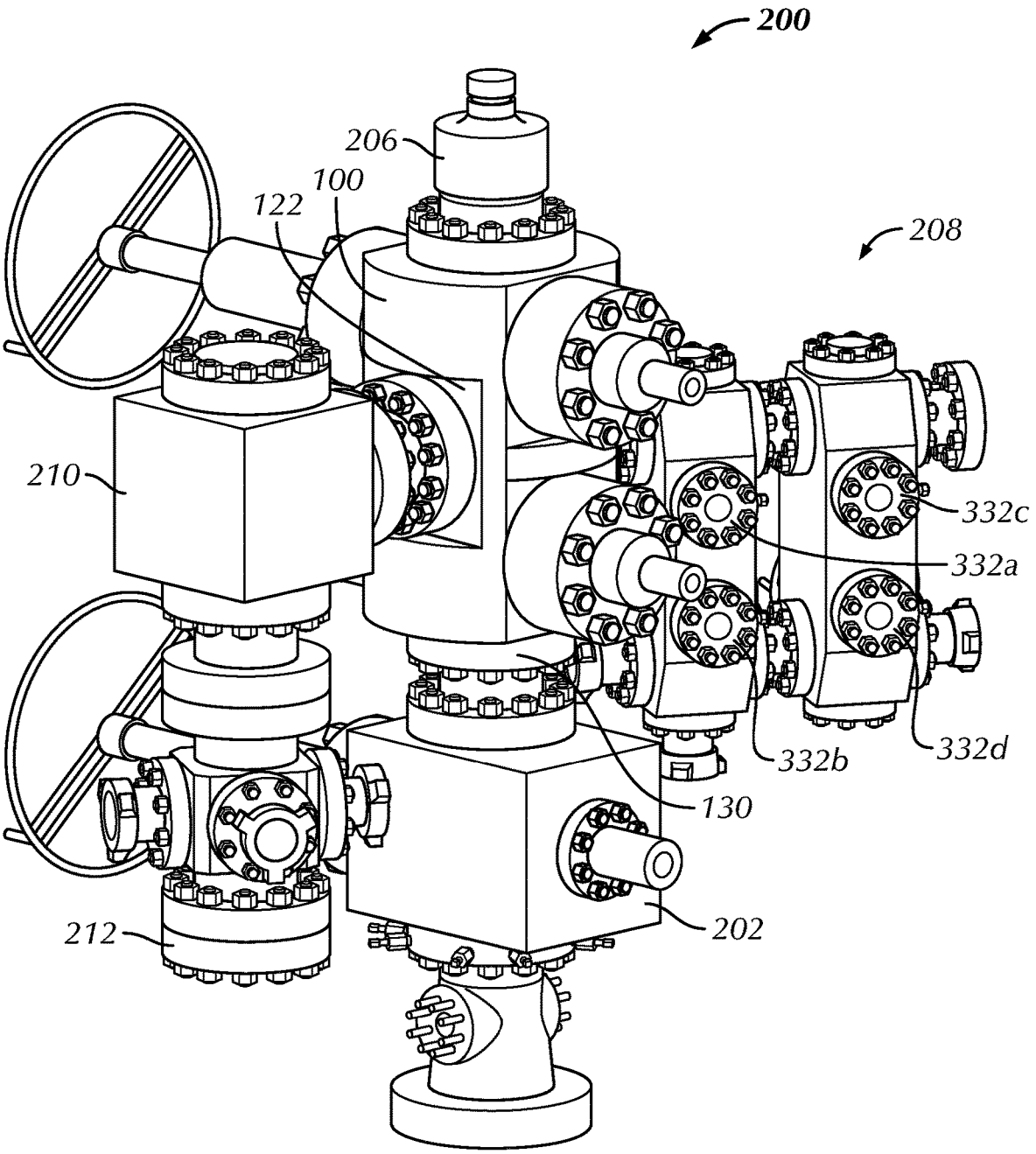
FIG. 5*b* is a back perspective view of a Christmas tree in accordance with the present disclosure.

In another aspect, the present disclosure relates to a Christmas tree including a connector block as described above. FIGS. 5*a*-5*b* illustrate embodiments of a Christmas tree 200 including a connector block 100, showing a front view and a back view, respectively.

The Christmas tree 200 may include a connector block 100 which has valves assembled therein. The connector block 100 may have a swab valve 152 and an upper master valve 154 assembled within and protruding from the valve chambers (126*a*, 126*b* in FIG. 4) and the rod housings 142*a*-142*d*. A valve actuator 156 may be attached to the rod of one or both of the valves 152, 154. The valve actuator 156 may allow the valve 152, 154 to be actuated, so as to open or close the axial bore (110 in FIGS. 3*a*-3*c*) of the connector block 100.

The connector block 100 may be connected to other components of the Christmas tree 200, such that the components of the Christmas tree 200 are in fluid communication with the axial bore, the wing bores (114*a*, 114*b* in FIGS. 3*a*-3*c*), or the frac bore (120 in FIGS. 3*a*-3*c*). In some embodiments, as shown in FIGS. 5*a*-5*b*, the connector block 100 may be connected to a lower master valve block 202 via the lower connector 130. The lower master valve block 202 may include a bore (not shown) which may be in fluid communication with the axial bore of the connector block 100. The lower master valve block 202 may include a gate valve, a plug valve, or any type of valve known in the art disposed therein. The valve may be controlled by a valve actuator 204. The valve may allow fluid to flow in a first direction, but not in a second direction.

The connector block 100 may be connected to a tree cap 206 via the upper connector 112. The tree cap 206 may include a chamber which is in fluid communication with the axial bore of the connector block 100. The tree cap 206 may prevent flow of fluid out of the top of the Christmas tree 200. In some embodiments, the tree cap 206 may allow fluid to flow out of the top of the Christmas tree 200 if another component is attached to the tree cap 206. In some embodiments, the connector block 100 may be connected to wellbore components other than a tree cap 206 via the upper connector 112. The wellbore components (not shown) may include a bore (not shown) in fluid communication with the axial bore 110.

The connector block 100 may be connected to a frac inlet 210 via the frac connector 124. The frac inlet 124 may include a bore which may be in fluid communication with the frac bore of the connector block 100. The frac inlet 210 may extend from the frac connector 124 to a height near the base of the Christmas tree 200. The lower end of the frac inlet 210 may include a frac line connector 212. The frac line connector 212 may allow a line (not shown) carrying frac fluid to be connected to the frac inlet 210, such that frac fluid may be injected into the Christmas tree 200.

The connector block 100 may be connected to one or more wing valve assemblies 208 via the wing connectors 118*a*, 118*b*. In some embodiments, as illustrated in FIGS. 5*a*-5*b*, a first wing connector 118*a* may be connected to a wing valve assembly 208 while a second wing connector 118*b* may be capped. In some embodiments, both wing connectors 118*a*, 118*b* may be connected to a wing valve assembly 208, such that a Christmas tree 200 includes two or more wing valve assemblies 208.

Figure 6:
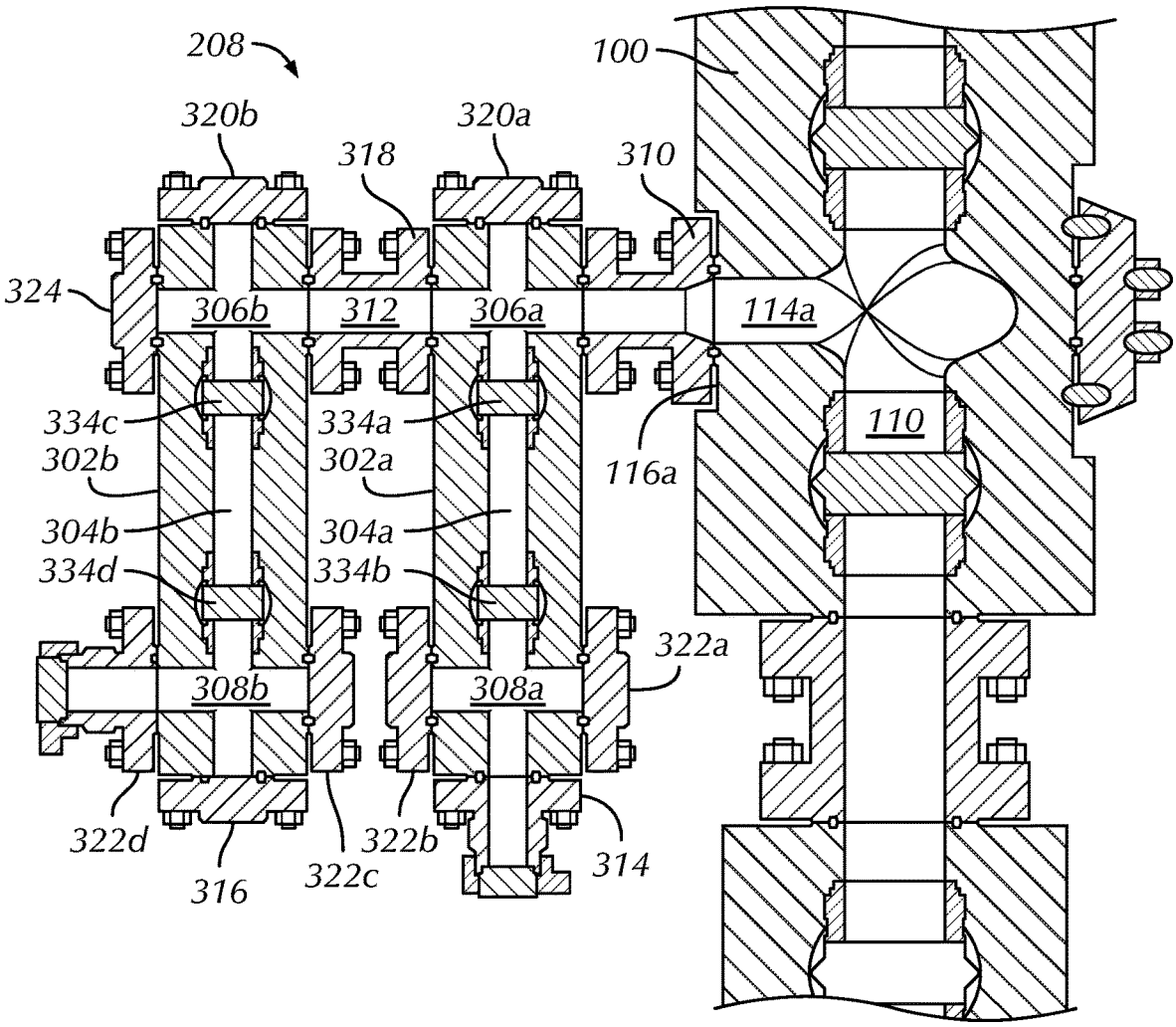
FIG. 6 is a cross-section view of a Christmas tree in accordance with the present disclosure.

FIG. 6 illustrates a cross section view of the interior of a wing valve assembly 208. The wing valve assembly 208 will be described with reference to FIGS. 5*a*, 5*b*, and 6. The wing valve assembly 208 is attached to the connector block 100 via a wing connector 118*a* and a flanged connection pipe 310. In some embodiments, the wing valve assembly 208 may be connected directly or indirectly to the wing connector 118. The valve assembly 208 may include two wing blocks 302*a*, 302*b*. Each wing block 302*a*, 302*b* may include an axial bore 304*a*, 304*b*, an upper transverse bore 306*a*, 306*b*, and a lower transverse bore 308*a*, 308*b*. The upper transverse bores 306*a*, 306*b* may be connected to form a longitudinal bore 312. In some embodiments, the upper transverse bores 306*a*, 306*b* may be connected via a flanged connection pipe 318. The longitudinal bore 312 may be in fluid communication with the wing bore 114*a* of the connector block 100.

The lower end of each axial bore 304*a*, 304*b* may comprise a connector. The connector of one wing block 302*a* may comprise a flow connector 314, which may be configured to be connected to a flow line (404 in FIG. 7). The connector of the other wing block 302*b* may comprise a pump connector 316, which may be configured to be connected to a pump down line (404 in FIG. 7). In some embodiments, the positions of the connectors 314, 316 may be reversed.

One or more valve assemblies may extend through each of the axial bores 304*a*, 304*b*. The valve assemblies may extend through the wing blocks 302*a*, 302*b*, and may terminate at a valve housing 328*a*, 328*b*, and/or a valve actuator (330*a*, 330*b* in FIG. 5*a*) at a first end and a bonnet cap (332*a*-332*d* in FIG. 5*b*). The valve assemblies and the wing blocks 302*a*, 302*b* may be relatively easy to clean because the valve assemblies are capped at both ends. The valve assemblies may comprise any type of valve known in the art, for example a gate valve or a plug valve. The valve assemblies may or may not be of the same type as each other. If the valve assemblies are gate valves, the valve assemblies may include gates 334*a*-334*d* which may be disposed within the axial bores 304*a*, 304*b*.

Ends of the bores which are not used to form connections may be capped. Upper ends of both axial bores 304*a*, 304*b* may terminate at bonnet caps 320*a*, 320*b*. Both ends of both lower transverse bores 308*a*, 308*b* may terminate at bonnet caps 322*a*-322*d*. A distal end of the upper transverse bore 306*b* of the second wing block 302 may terminate at a bonnet cap 324. Although these ends may be capped as shown in FIG. 6 in some embodiments, they may be used to form connections to other wellbore components in other embodiments, providing the wing valve assembly 208 with significant process flexibility.

A Christmas tree 200 including a connector block 100 may have a reduced profile compared to a traditional Christmas tree 10. For example, a Christmas tree 200 according to the present disclosure may have a width between five and fifteen feet, between eight and twelve feet, or about nine and a half feet. A Christmas tree 200 according to the present disclosure may have a height between five and twenty feet, between eight and fifteen feet, or about ten and a quarter feet. A Christmas tree 200 according to the present disclosure may have a weight between twenty thousand and thirty thousand pounds, between twenty-two thousand and twenty-eight thousand pounds, or about twenty-five thousand pounds. Compared to prior art Christmas trees 10 described in the background, a Christmas tree 200 according to the present disclosure may have a lesser width, height, and weight. The reduced profile may increase the ease with which the Christmas tree 200 may be installed and used, and may allow the Christmas tree 200 to be assembled offsite and then transported to a well site.

The valve actuators 156, 204 of the check valve, the swab valve 152, and the upper master valve 154 may all be reachable by an operator standing on the ground. This contrasts with the valve actuators of a traditional Christmas tree 10, as shown in FIG. 1, in which at least one valve actuator cannot be reached without the use of a lift or platform. Having all the valve actuators 156, 204 reachable from the ground may reduce the time necessary to perform operations on the Christmas tree 200, improve the safety of the operations, and reduce equipment such as stands and lifts associated with wellbore operations.

Figure 2:
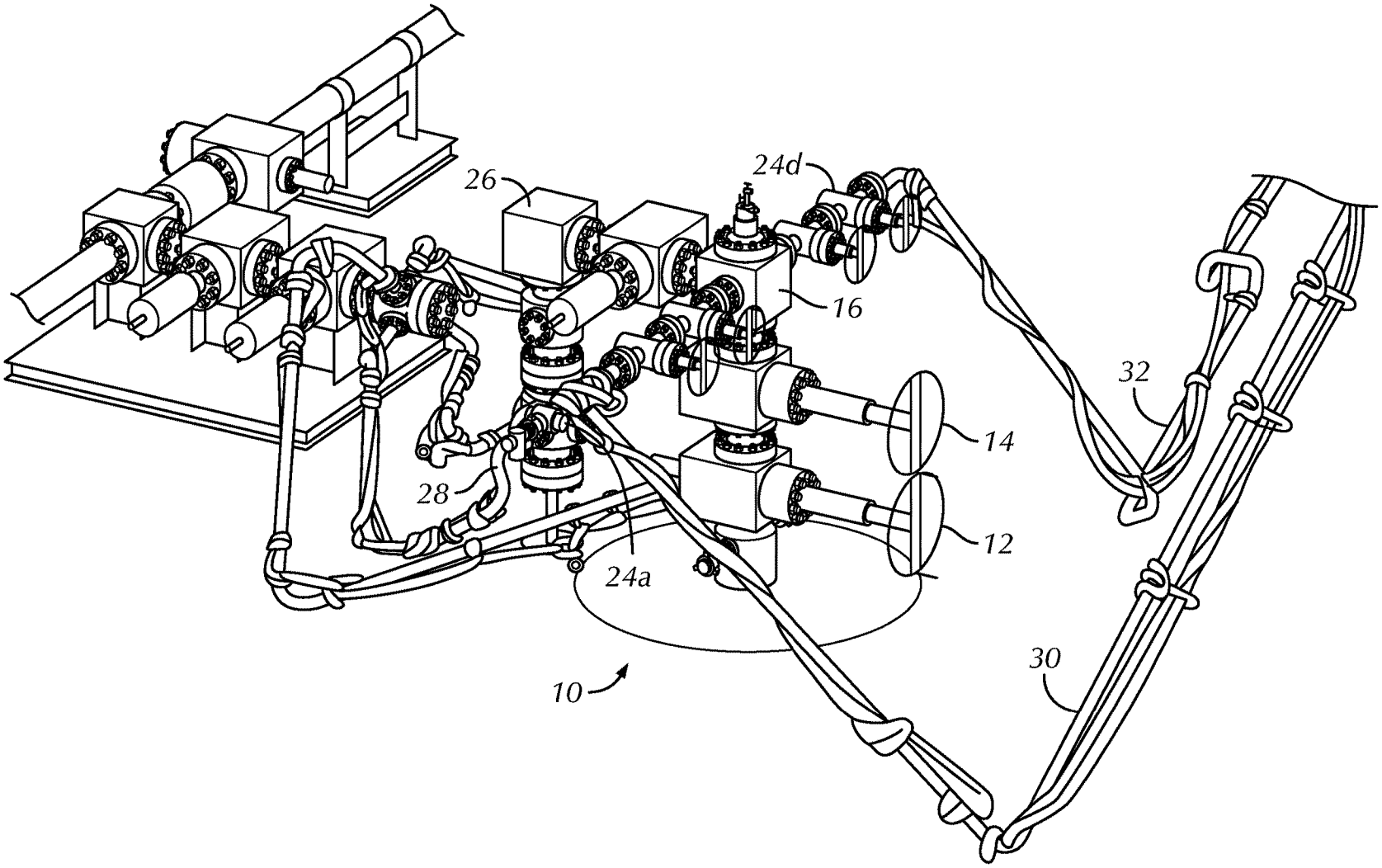
FIG. 2 (Prior Art)
FIG. 2 is a perspective view of a system in accordance with the prior art.

The frac line connector 212 may be closer to the ground than the frac line connector 26 on a traditional Christmas tree 10, as shown in FIG. 2. This may improve the ease of assembly of a wellbore system including a Christmas tree 200 having a connector block 100 compared to a traditional Christmas tree 10. It may further prevent failure of the connection between the frac line and the frac line connector 212 and damage to the surrounding equipment, thereby improving safety and decreasing downtime of the system.

In another aspect, embodiments of the present disclosure relate to a method of manufacturing a connector block and methods of assembling a Christmas tree including a connector block and a wellbore system including a Christmas tree.

A connector block 100 may be manufactured according to some or all of the following steps, with reference to FIGS. 3*a*-3*c*. A body 102 may be formed, for example by forging. In some embodiments, the body 102 may be formed as a round forging. The body 102 may be formed of a metal or other material, which may be resistant to erosion and/or corrosion.

An axial bore 110 may be formed through the body 102, such that the axial bore 110 extends from a top surface 104 to a bottom surface 106 of the body. The axial bore 110 may be formed by any means known in the art, for example by drilling or machining. An upper connector 112 may be formed on the top surface 104 proximate an end of the axial bore 110. A lower connector 130 may be formed on the bottom surface 106 proximate an end of the axial bore 110.

One or more valve chambers 126*a*, 126*b* may be formed through the body 102, such that the valve chambers 126*a*, 126*b* pass entirely through the body 102 and intersect the axial bore 110. The valve chambers may be formed by any means known in the art, for example by drilling or machining. Bonnet connection faces 128*a*-128*d* may be formed on an outer surface 108 of the body 102 as flat surfaces proximate the ends of the valve chambers 126*a*, 126*b*. The bonnet connection faces 128*a*-128*d* may be formed by any means known in the art, for example by machining. Bonnet connectors 158*a*-158*d* may be formed on the bonnet connection faces 128*a*-128*d* by any means known in the art.

One or more wing bores 114*a*, 114*b* may be formed through the body 102, such that the wing bores 114*a*, 114*b* extend from an outer surface 108 of the body and intersect the axial bore 110. The wing bores 114*a*, 114*b* may be formed by any means known in the art, for example by drilling or machining. Wing connection faces 116*a*, 116*b* may be formed on an outer surface 108 of the body 102 as flat surfaces proximate an end of each wing bore 114*a*, 114*b*. The wing connection faces 116*a*, 116*b* may be formed by any means known in the art, for example by machining. Wing connectors 118*a*, 118*b* may be formed on the wing connection faces 116*a*, 116*b*, by any means known in the art.

One or more frac bores 120 may be formed through the body 102, such that a frac bore 120 extends from an outer surface 108 of the body and intersect the axial bore 110. The frac bore 120 may be formed by any means known in the art, for example by drilling or machining. Frac connection faces 122 may be formed on an outer surface 108 of the body 102 as flat surfaces proximate an end of each frac bore 120. The frac connection face 122 may be formed by any means known in the art, for example by machining. Frac connectors 124 may be formed on the frac connection faces 122, by any means known in the art.

One or more valves 152, 154 may be assembled in the one or more valve chambers 126*a*, 126*b*. A rod 144*a*, 144*b* having a valve element such as a gate 146*a*, 146*b* disposed thereon may be disposed within each valve chamber 126*a*, 126*b*. A bonnet 140*a*-140*d* may be connected to each bonnet connection face 128*a*-128*d*, such that an end of the rod 144*a*, 144*b* extends through the bonnet 140*a*-140*d*. Rod housings 142*a*-142*d* may be secured to each bonnet 140*a*-140*d* such that an end of a rod 144*a*, 144*b* extends through each rod housing 142*a*-142*d*. The interface between the rod housings 142*a*-142*d* may be made to be fluid-tight. In some embodiments, a valve actuator 156 may be attached to the end of a rod 144*a*, 144*b*.

A Christmas tree 200 including a connector block 100 assembled as described above, may be assembled following some or all of the following steps, with reference to FIGS. 5*a*-5*b*. A lower master valve block 202 may be attached to a lower connector 130 of connector block 100 via any means known in the art. A tree cap 206 may be attached to an upper connector 112 of the connector block 100 via any means known in the art. One or more wing valve assemblies 208 may be attached to wing connectors 116*a*, 116*b* of the connector block 100 via any means known in the art. A frac inlet 210 may be attached to the frac connector 124 of the connector block 100 via any means known in the art.

The Christmas tree 200 of the present disclosure may be easier to assemble and install than a traditional Christmas tree 10. Because the connector block 100 contains the swab valve 152, the upper master valve 154, the wing connectors 118*a*, 118*b*, and the frac connector 124, separate components including these elements do not have to be connected and tested prior to operation of the Christmas tree 200. In addition to reducing the time and personnel necessary to install the Christmas tree 200, such a configuration reduces the number of points at which the Christmas tree 200 may fail, and may therefore reduce the likelihood of the Christmas tree 200 failing.

Figure 7:
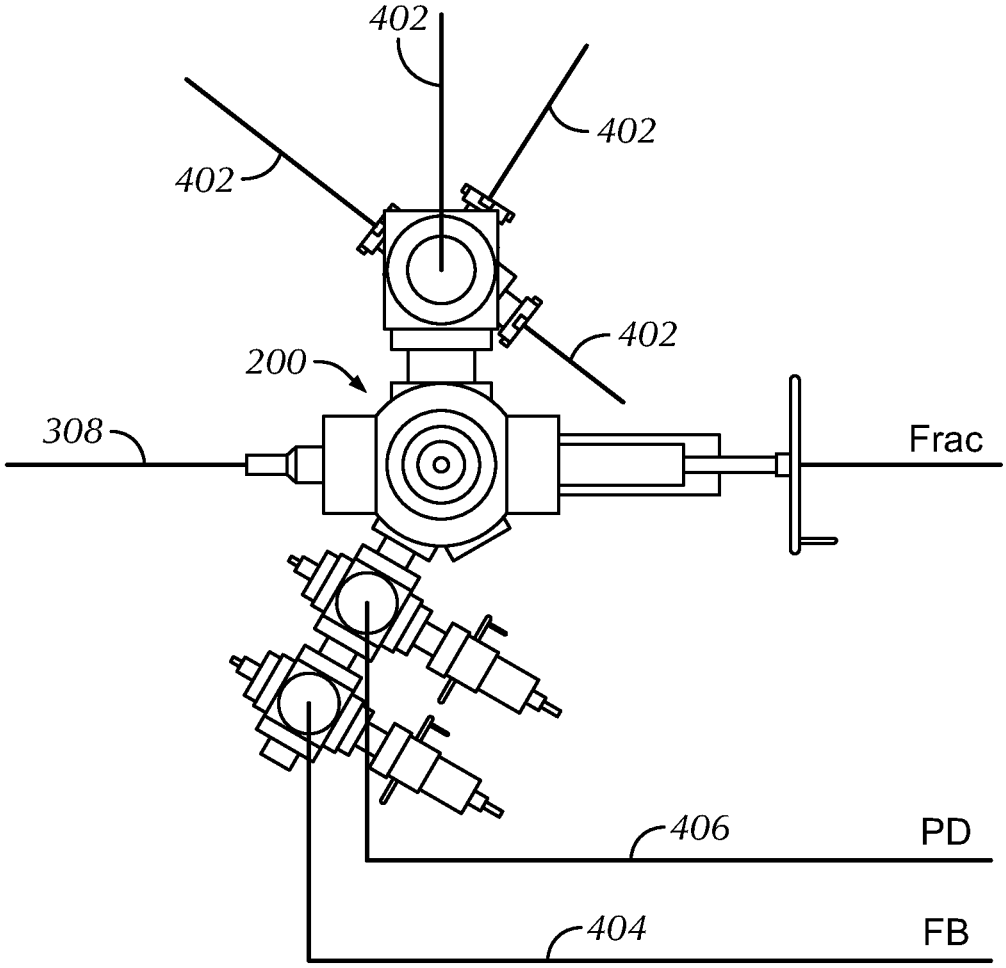
FIG. 7 is a schematic diagram of a system in accordance with the present disclosure.

FIG. 7 illustrates a wellbore system 400 including a Christmas tree 200. The Christmas tree 200 may include some or all of the components described above. The system 400 includes a wellhead element (not shown), such that the Christmas tree 200 may be mounted on the wellhead element. The lower master valve block 202 may be connected to the wellhead element. One or more frac lines 402 may be connected to the frac inlet connector 212, a pump down line 404 may be connected to the pump connector 316, and a flow back line 406 may be connected to the flow connector 314. The frac lines 402 may be disposed on a first side of a central axis 408 while the pump down line 404 and the flow back line 406 may be disposed on a second side of the central axis 408. If more than one Christmas tree 200 is arranged in a line at a well site, each Christmas tree 200 may have lines connected thereto, such that all frac lines 402 are on a first side of the central axis 408 and all pump down lines 404 and flow back lines 406 are disposed on a second side of the axis 408.

Because Christmas tree 200 has a reduced size compared to traditional Christmas trees, the Christmas tree 200 may be able to be fully assembled off site. The components of the Christmas tree 200 may be connected and tested at an offsite facility. The Christmas tree 200 may then be transported, for example, via a truck, to a wellbore site. At the wellbore site, the lower master valve block 202 may be connected to a wellhead element. One or more frac lines 402 may be connected to the frac inlet connector 212, a pump down line 404 may be connected to the pump connector 316, and a flow back line 406 may be connected to the flow connector 314. If the Christmas tree 200 is removed from the wellbore site, only these four connections may have to be broken. Therefore, installing and removing the Christmas tree 200 may require less time and personnel than installing and removing a traditional Christmas tree 10.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed is:

1. A connector block, configured for use in a Christmas tree, the connector block comprising:

a single piece body having:

an axial bore formed therethrough, the axial bore having an axis;

two valve chambers, passing fully through the connector block and intersecting the axial bore, each of the two valve chambers having an axis;

a frac bore, extending from an outer surface of the connector block to the axial bore, the frac bore having an axis; and two wing bores, extending from the outer surface of the connector block to the axial bore, wherein the axis of each of the two valve chambers is parallel to the axis of the other of the two valve chambers and perpendicular to the axis of the axial bore, wherein one of the two valve chambers is disposed above a plane including the axis of the frac bore and an axes of the wing bores, and wherein the other of the two valve chambers is disposed below the plane including the axis of the frac bore and the axes of the wing bores.

2. The connector block of claim 1, wherein the axial bore extends from an upper face of the connector block to a lower face of the connector block.

3. The connector block of claim 1, wherein the two valve chambers, the frac bore, and the two wing bores are orthogonal to the axial bore.

4. The connector block of claim 1, wherein the axis of the frac bore is orthogonal to a plane comprising the axial bore and the two valve chambers.

5. The connector block of claim 1, wherein an axis of each of the two wing bores is coplanar with each of the axes of the other the two wing bores, such that the axes of the two wing bores intersect at a point within the axial bore.

6. The connector block of claim 5, wherein an angle of between fifteen and thirty-five degrees is formed between the axes of the wing bores.

7. The connector block of claim 1, wherein the frac bore are disposed on an opposite side of a plane comprising the axial bore and the two valve chambers from the two wing bores.

8. The connector block of claim 1, wherein the outer surface of the connector block comprises a planar face surrounding an end of each of the two valve chambers, the frac bore, and the two wing bores.

9. The connector block of claim 1, further comprising one or more bonnet caps, such that two ends of each valve chamber which intersect the outer surface of the connector block are covered by a bonnet cap.

10. The connector block of claim 1, wherein:

the axis of the frac bore and an axes of the wing bores are coplanar, an angle of between twenty and forty degrees is formed between the axes of the wing bores, the axis of the frac bore is collinear with a line which bisects the angle formed by the axes of the wing bores, and the axis of the frac bore and the axes of the wing bores are normal to the axis of the axial bore.

11. The connector block of claim 1, wherein the frac bore has a diameter of between five and nine inches, the axial bore has a diameter of between five and nine inches, and the wing bores have diameters of between two and six inches.

12. A Christmas tree comprising:

a connector block comprising:

a single piece body having:

an axial bore formed therethrough;

one or more valve chambers, passing fully through the connector block and intersecting the axial bore;

a frac bore, extending from an outer surface of the connector block to the axial bore; and one or more wing bores, extending from the outer surface of the connector block to the axial bore; and one or more valve assemblies, each of the one or more valve assemblies disposed within a wing bore, and each of the one or more valve assemblies comprising a flow control element disposed within the axial bore; and a means of actuating the flow control element;

one or more wing valve assemblies, the one or more wing valve assemblies being connected to the connector block, such that a longitudinal bore of each of the one or more wing valve assemblies is fluidly connected to one of the one or more wing bores;

a frac connector connected to the connector block, such that a bore of the frac connector is fluidly connected to the frac bore;

a lower component connected to a lower end of the connector block, such that an axial bore of the lower component is fluidly connected to the axial bore; and an upper component connected to an upper end of the connector block, such that an axial bore of the upper component is fluidly connected to the axial bore.

13. The Christmas tree of claim 12, wherein the flow control element is a gate or a plug.

14. The Christmas tree of claim 12, wherein the one or more valve assemblies further comprise a valve actuator, two bonnet caps covering respective ends of the valve chamber which intersects the outer surface of the connector block, and a rod, extending through the bonnets and the valve chamber.

15. The Christmas tree of claim 12, wherein the frac connector is configured to connect the frac bore to a frac line.

16. The Christmas tree of claim 15, wherein the frac connector extends to a level approximately even with a lower end of the lower component.

17. The Christmas tree of claim 12, wherein the lower component comprises a lower master valve valve.

18. The Christmas tree of claim 12, wherein the one or more wing valve assemblies comprise:

two wing blocks comprising:

an axial bore, having a connector disposed at a lower end;

an upper transverse bore; and a lower transverse bore, wherein each transverse bore is terminated at two ends by a bonnet cap, and wherein the upper transverse bores are connected to form the two longitudinal bore.

* * * * *